US008567500B2

(12) United States Patent
Bedouet et al.

(10) Patent No.: US 8,567,500 B2
(45) Date of Patent: Oct. 29, 2013

(54) COOLING APPARATUS AND METHODS FOR USE WITH DOWNHOLE TOOLS

(75) Inventors: Sylvain Bedouet, Houston, TX (US); Erik Quam, Sugar Land, TX (US); Nicholas Ellson, Bristol (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 833 days.

(21) Appl. No.: 12/573,968

(22) Filed: Oct. 6, 2009

(65) Prior Publication Data

US 2011/0079391 A1 Apr. 7, 2011

(51) Int. Cl.
*E21B 36/00* (2006.01)

(52) U.S. Cl.
USPC ..... 166/302; 166/57; 175/17

(58) Field of Classification Search
USPC ..... 166/302, 57, 243; 62/259.2, 271, 66; 175/17, 16, 50; 73/863.1
See application file for complete search history.

(56) References Cited

U.S. PATENT DOCUMENTS

| | | | | |
|---|---|---|---|---|
| 5,931,000 | A | 8/1999 | Turner et al. | |
| 7,735,528 | B2 * | 6/2010 | Handa | 141/82 |
| 2005/0097911 | A1 | 5/2005 | Revellat et al. | |
| 2006/0102353 | A1 | 5/2006 | Storm et al. | |
| 2006/0144619 | A1 | 7/2006 | Storm et al. | |
| 2006/0162931 | A1 | 7/2006 | Mayes | |
| 2007/0114021 | A1 | 5/2007 | Brown et al. | |
| 2007/0223999 | A1 * | 9/2007 | Curlett | 405/55 |
| 2008/0223579 | A1 | 9/2008 | Goodwin | |
| 2008/0314638 | A1 | 12/2008 | Kaul et al. | |

FOREIGN PATENT DOCUMENTS

WO WO2008100156 8/2008

* cited by examiner

*Primary Examiner* — Yong-Suk (Philip) Ro
(74) *Attorney, Agent, or Firm* — Cathy Hewitt; John Vereb

(57) ABSTRACT

Cooling apparatus and methods for use with downhole tools are described. An example apparatus includes a cooling apparatus for use with a downhole tool. The cooling apparatus includes a flow passage having an inlet and an outlet. The outlet is configured for fluid communication with a wellbore and the inlet is spaced from the outlet. The cooling apparatus also includes a pump configured to convey at least one of a drilling fluid or a formation fluid between the inlet and the outlet. Additionally, the cooling apparatus includes a heat exchanger coupled to a surface adjacent the flow passage and a component of the downhole tool to convey heat from the component to the cooling fluid.

21 Claims, 15 Drawing Sheets

COOLING APPARATUS AND METHODS FOR USE WITH DOWNHOLE TOOLS

BACKGROUND

During and/or after drilling operations, different tools may be included in a tool string or downhole tool to evaluate the formation or to perform other tasks. Some of these tools include electronic or moving parts that generate significant amounts of heat when used. In some instances, the heat, which may be exacerbated when using the tools in high temperature wells, may decrease the functionality of these tools or cause them to fail.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
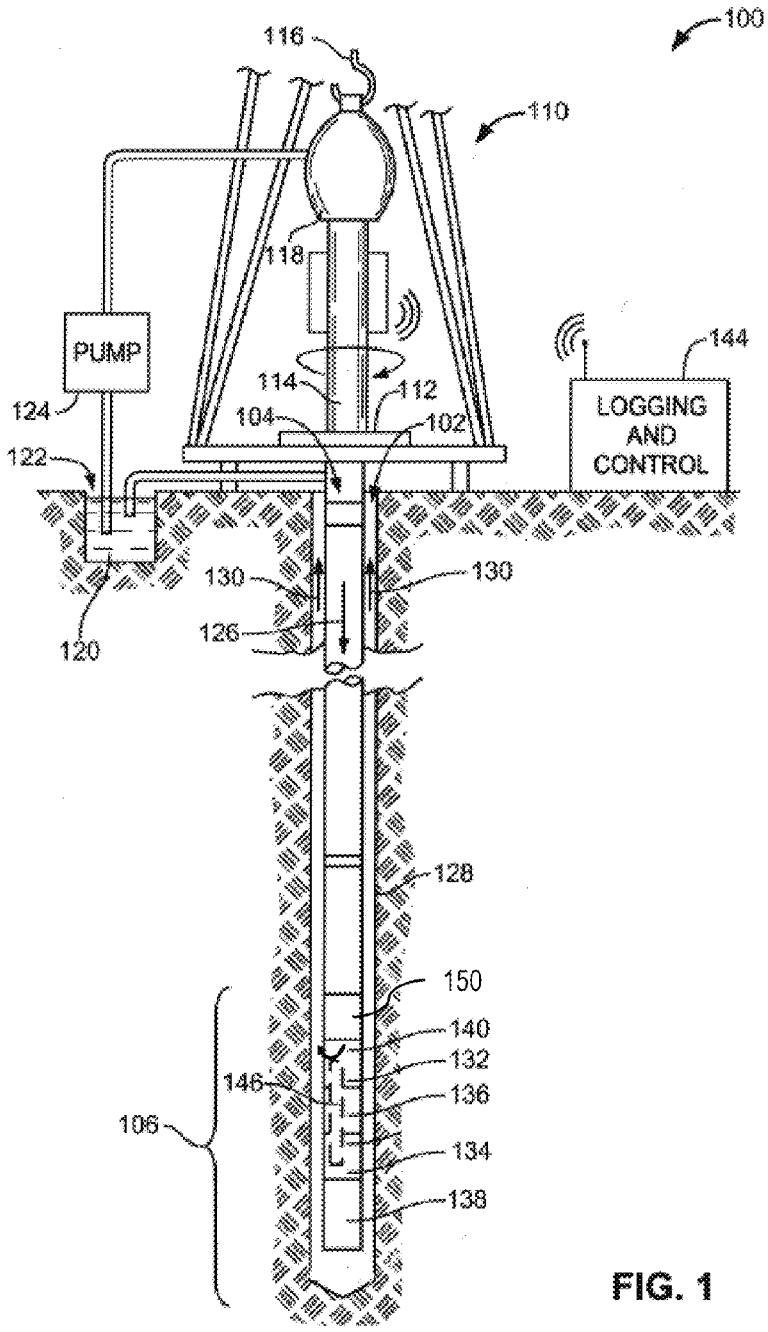
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The examples described herein may relate to cooling apparatus and methods that may be used to cool heat-generating components disposed in a downhole tool, among other uses. The example cooling apparatus and methods described herein may relate to directionally dissipating or transferring heat energy away from one or more heat-generating components in a downhole tool. Such directional dissipation or transfer of heat energy enables efficient cooling of one or more heat-generating components in a downhole tool. In particular, the geometry of a downhole tool defines an elongate structure having a small diameter or cross-sectional area compared to the length of the tool. Thus, the cooling apparatus described herein are configured to efficiently dissipate heat energy along the length of the tool, thereby transferring the heat energy generated by one or more components of the tool a greater distance away from the component(s) than would otherwise be possible by only conducting or otherwise transferring the heat energy to surfaces (e.g., an outside surface) of the tool adjacent or local to the component(s). Further, the example cooling apparatus and methods described herein may relate to flowing (e.g., pumping) a cooling fluid (e.g., drilling fluid and/or formation fluid) through a flow path or passage and past or adjacent a heat exchanger to which a heat-generating component is coupled and thereafter discharging the fluid into the wellbore or wellbore. Such an approach may enable heat generated by components in a downhole tool to be dissipated efficiently, and may be significantly less complex to implement relative to some known cooling systems. Still further, the heat exchangers employed by the example cooling apparatus and methods described herein may include thermal heat strips and/or heat pipes as described in greater detail below to facilitate the directional transfer of heat energy away from heat-generating components in a downhole tool along the length of the tool.

FIG. 1 illustrates an example well site system 100 that can be employed onshore and/or offshore and which may implement the example cooling apparatus described herein. For example, the example well site system 100 may be used to determine a production capacity one or more of the formations constituting a hydrocarbon reservoir, such as described in PCT Patent Application Pub. No. WO 2008/100156, included herein by reference.

In the example well site system of FIG. 1, a wellbore 102 is formed in one or more subsurface formations by rotary and/or directional drilling. As illustrated in FIG. 1, a drill string 104 is suspended in the wellbore 102 and has a tool string 106. A surface system includes a platform and derrick assembly 110 positioned over the wellbore 102. The derrick assembly 110 includes a rotary table 112, a kelly 114, a hook 116 and a rotary swivel 118. The drill string 104 is rotated by the rotary table 112, energized by means not shown, which engages the kelly 114 at an upper end of the drill string 104. The example drill string 104 is suspended from the hook 116, which is attached to a traveling block (not shown), and through the kelly 114 and the rotary swivel 118, which permits rotation of the drill string 104 relative to the hook 116. Additionally, or alternatively, a top drive system could be used.

In the example depicted in FIG. 1, the surface system further includes drilling fluid 120, which is commonly referred to in the industry as mud, and which is stored in a pit 122 formed at the well site. A pump 124 delivers the drilling fluid 120 to the interior of the drill string 104 via a port in the rotary swivel 118 and causes the drilling fluid 120 to flow downwardly through the drill string 104 as indicated by the directional arrow 126. The drilling fluid 120 may exit the drill string 104 via outlets 140 provided in a flow diverter module 132 disposed in the tool string 106, and then circulates upwardly through the annulus region between the outside of the drill string 104 and a wall 128 of the wellbore 102, as indicated by the directional arrows 130. The drilling fluid 120 is returned to the pit 122 for recirculation.

The example tool string 106 of FIG. 1 includes, among other things, any number and/or type(s) of logging-modules or tools (three of which are designated by reference numerals 134, 136 and 138) and/or power and communication modules (one of which is designated by reference numeral 150). The power and communication module 150 may comprise telemetry means (such as Mud Pulse telemetry, Wired Drill Pipe telemetry) for communicating with the surface equipment such as, for example, a logging and control computer 144. The power and communication module 150 may also comprise means for providing electrical power to the tools in the tool string 106, such as a mud powered turbine coupled to an alternator, batteries, fuel cells, etc. . . . While a power and communication module 150 is depicted in the example of FIG. 1 to provide electrical power to the tool string 106 and/or communication with the surface equipment, an armored cable (such as a wireline cable) may alternatively or additionally be used within the scope of the present disclosure.

The example logging modules or tools 134, 136 and/or 138 of FIG. 1 may contain any number of logging tools and/or fluid extraction devices. The example logging modules or tools 134, 136 and/or 138 may include capabilities for measuring, processing and/or storing information, and possibly for communicating with the power and communication module 150 and/or directly with the surface equipment such as, for example, a logging and control computer 144.

The logging and control computer 144 may include a user interface that enables parameters to be input and/or outputs to be displayed. While the logging and control computer 144 is depicted uphole and adjacent the well site system, a portion or the entire logging and control computer 144 may be positioned in the bottomhole assembly 106 and/or in a remote location.

To cool the logging modules or tools 134, 136 and/or 138, the drill string 104 and, specifically, the tool string 106 includes a cooling apparatus 146. As discussed in more detail below, the cooling apparatus 146 may cool the logging modules or tools 134, 136 and/or 138 and/or any other component positioned in the drill string 104 by flowing a cooling fluid (e.g., drilling fluid and/or formation fluid) through a flow path or passage adjacent a heat exchanger coupled to the component(s) and thereafter discharging the cooling fluid into the wellbore 102.

Figure 2:
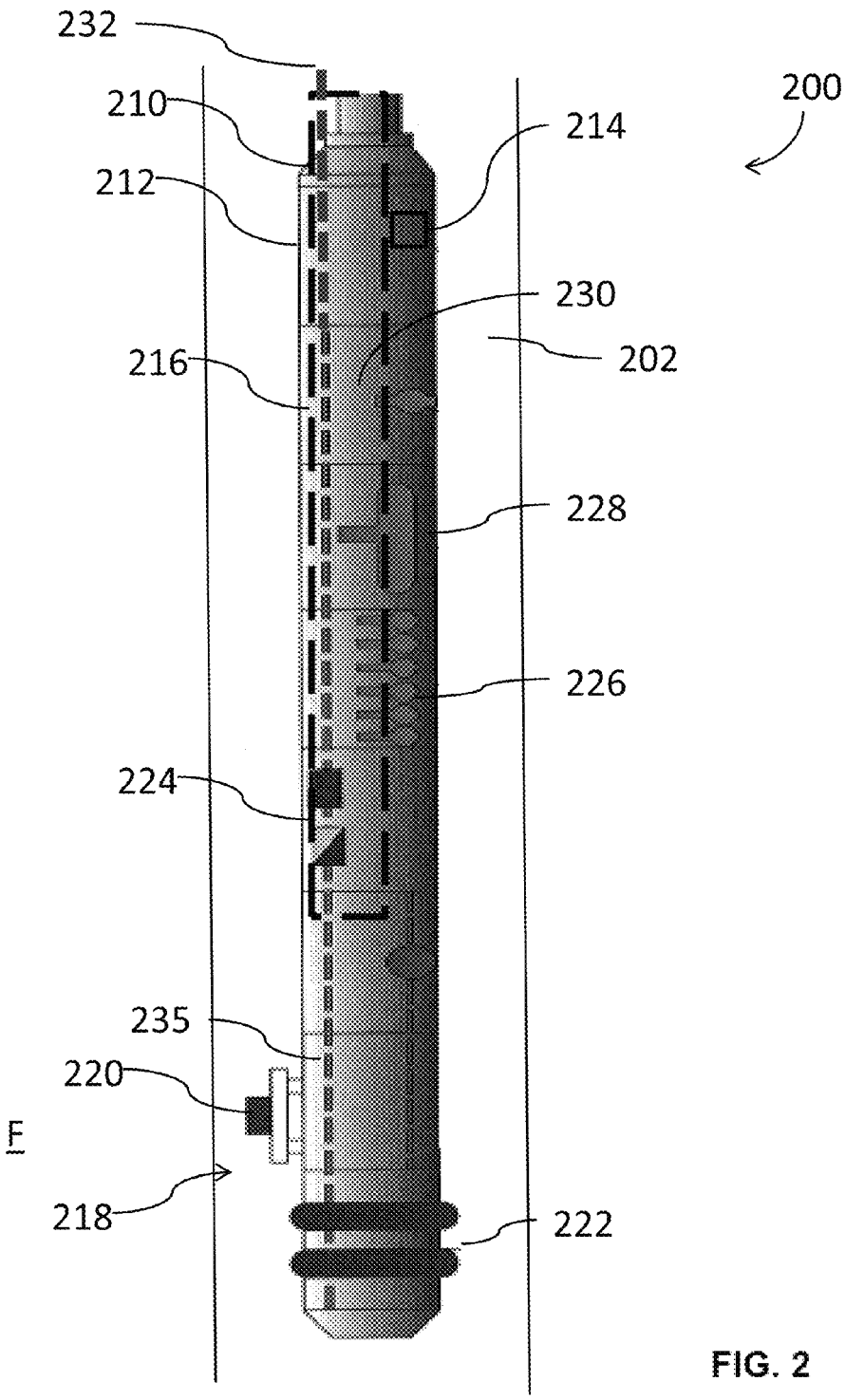
FIG. 2 is a schematic view of apparatus according to one or more aspects of the present disclosure.

FIG. 2 depicts an example tool string portion 200 that may be used to extract and analyze formation fluid samples, and which may implement the example cooling apparatus described herein. For example, the tool string portion may be used to implement the logging modules or tools 134, 136, 138 of the tool string 106 in FIG. 1. The example tool string portion 200 may be configured to cool a component positioned within the example tool string portion 200 by flowing fluid past or adjacent a heat exchanger to which the component is thermally coupled.

As shown in FIG. 2, the example tool string portion 200 is suspended in a wellbore or wellbore 202. The example tool string portion 200 includes an elongated body 210. The example tool string portion 200 may be of modular type. Thus, components of the example tool string portion 200 may be omitted, rearranged, or duplicated, as well known in the art. The tool string 200 may include one or more downhole control systems 214 that may be configured to control extraction of formation fluid from a formation F, perform measurements on the extracted fluid and/or to control the apparatus described herein to cool one or more components positioned within the tool string portion 200. The downhole control system 214 may control an example cooling apparatus 216 (for example similar to the cooling apparatus 146 in FIG. 1) that cools the component(s) positioned within the tool string portion 200 by, for example, flowing fluid (e.g., drilling fluid and/or formation fluid) through a flow path or passage adjacent a heat exchanger coupled to the component and thereafter discharging the cooling fluid into the wellbore 202, as described in more detail below.

The example tool string portion 200 may include an electronics module 212. The electronics module 212 may provide an interface between the tool string 200 and, for example, a wireline cable (not shown). Additionally or alternatively, the electronics module 212 may be provided with an interface to a telemetry system to convey data, commands and/or other signals or information between the tools and, for example, surface devices.

The example tool string portion 200 includes a formation tester 218 including, for example, a selectively extendable probe assembly 220 and/or a selectively inflatable straddle packer 222. The extendable 220 probe and/or the inflatable straddle packer 222 may be configured to selectively seal off or isolate selected portions of the wall of the wellbore 202 to fluidly couple to an adjacent formation F and draw fluid samples from the formation F.

The example tool string portion 200 includes a pump module 230 configured to extract fluid samples from the formation F via the selectively extendable probe assembly 220 and/or the selectively inflatable straddle packer 222, among other functions. The pump module 230 may include a power electronics assembly (not shown) to drive electric components in the pump module 230. The pump module 230 may include an electric motor (not shown) operatively coupled to a hydraulic pump (not shown). The hydraulic pump may be configured to reciprocate a piston (not shown) disposed in a displacement unit (not shown). The motor and pump may thus reciprocate the piston of the displacement unit, thereby pumping sample fluid through a flow line 235 from the formation F into the tool string 200. The sample fluid may thereafter be expelled through an exit port 232 or the sample fluid may be collected in one or more fluid collecting chambers 226 and 228. The fluid collecting chambers 226 and 228 may receive and retain the formation fluid samples for subsequent testing at the surface or a testing facility.

The example tool string portion 200 may also include a fluid analysis module 224 through which the fluid samples obtained from the formation F may flow. The fluid analysis module 224 may be configured to analyze the measurement data of the fluid samples. The fluid analysis module 224 may be configured to generate and store the measurement data and subsequently communicate the measurement data to the surface for analysis at the surface.

The example tool string portion 200 may be used in conjunction with the example methods and apparatus described herein to cool one or more components that generate heat in operation. Such an approach may enable heat generated by the component(s) to be dissipated efficiently, thereby decreasing the likelihood that the component(s) will fail in operation due to excessive temperatures to which they may be exposed. Examples of components that may be cooled using the examples described herein include, but are not limited to, downhole motors, downhole pumps, power electronics, electronic assemblies, sensors, and fluid measurement units.

While the cooling apparatus and methods of the present disclosure are described in connection with a drill string such as that shown in FIG. 1 and an example tool string portion 200 comprising a formation tester 218 such as that shown in FIG. 2, the cooling apparatus and methods of the present disclosure may be implemented with any other type of wellbore conveyance, and/or other types of downhole tools.

FIGS. 3A, 3B, 3C and 3D depict cooling apparatus that may be used separately or in combination to implement the cooling apparatus 146 of FIG. 1, the cooling apparatus 216 of FIG. 2 or any of the other examples described herein. The cooling apparatus of FIGS. 3A, 3B, 3C and 3D comprise a flow passage having an inlet and an outlet, wherein the outlet is configured for fluid communication with a wellbore, and wherein the inlet is spaced from the outlet, a pump configured to convey a cooling fluid, for example a drilling fluid or a formation fluid, between the inlet and the outlet, and a heat exchanger coupled to a surface adjacent the flow passage and a component of a downhole tool to convey heat from the component to the cooling fluid. The cooling apparatus shown in FIGS. 3A, 3B, 3C and/or 3D may be made integral to one or more downhole tools. Alternatively, existing tools or tool strings may be retrofitted with the cooling apparatus shown in FIGS. 3A, 3B, 3C and/or 3D or other examples described herein with minor modifications to provide the existing tools or tool strings with a cooling system similar to those described herein.

Figure 3A:
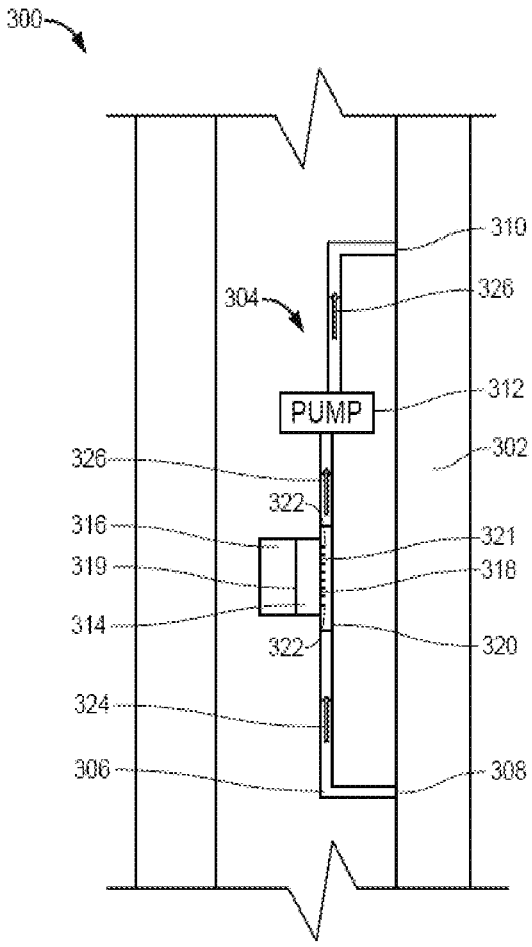
FIGS. 3A, 3B, 3C and 3D are schematic views of apparatus according to one or more aspects of the present disclosure.

FIG. 3A depicts a portion of a downhole tool string 300 positioned in a wellbore 302. The downhole tool string 300 includes a cooling apparatus 304. The cooling apparatus 304 includes a flow path, passage or flow line 306 having an inlet 308 spaced from an outlet 310 and in fluid communication with the wellbore 302. Thus, the flow line 306 is configured as an open loop system. Additionally, the cooling apparatus 304 includes a pump 312 to pump a cooling fluid (e.g., wellbore fluid and/or drilling fluid) through the flow line 306. The cooling apparatus 304 also includes a heat exchanger or heat sink 314 coupled between a component or heat producing component 316 in the downhole tool string 300 and a surface 318 adjacent the flow line 306.

The thermal resistance of an interface or contact(s) 319 between the heat exchanger 314 and the component 316 and/or the thermal resistance of an interface or contact(s) 321 between the heat exchanger 314 and the flow line 306 may be relatively small. For example, if the contacts 319 and/or 321 include aluminum or aluminum with silicone oil interfacial fluid, the thermal resistance of the contacts 319 and/or 321 may be approximately 0.5*10E4 $m^2K/W$.

The shape and/or composition of the flow line 306 and/or the heat exchanger 314 may be configured to increase the rate and/or amount of heat dissipated, conducted or transferred from the component 316 through the heat exchanger 314 to the cooling fluid as the cooling fluid flows through the flow line 306. For example, a portion 320 of the flow line 306, including the surface 318, may partially or substantially comprise a barium-copper alloy, beryllium-copper, another material comprising copper, and/or other thermally conductive material. The portion 320 may have a rectangular shape and/or the surface 318 may be a substantially flat surface to increase the surface area of the surface 318 exposed to the cooling fluid as the cooling fluid flows through the flow line 306. To further increase the surface area of the flow line 306 exposed to the cooling fluid, the cooling apparatus 314 may include extensions or fins 322 that extend into the flow line 306 and into the cooling fluid path.

The heat exchanger 314 may be designed to minimize the temperature rise of the component 316 over the environment temperature (e.g., the temperature within wellbore 302) while efficiently dissipating heat from the component 316 to the fluid in the flow line 306 and/or directionally moving heat away from the component 316. In an example, the temperature rise of the component (e.g., an electrical component) 316 may be approximately 25° C. above environment temperature and the amount of heat dissipated from the component 316 may be approximately 200 Watts.

The heat exchanger 314 may be any type of heat exchanger or may be a combination of various heat-exchanging devices. For example, the heat exchanger 314 may be a solid piece of material, may include a heat pipe and/or may include thermal strips. If the heat exchanger 314 is made of a solid piece of material, the material may be a highly thermally conductive material and/or have a large thermal capacitance. For example, the heat exchanger 314 may partially or substantially comprise aluminum having a thermal conductivity of approximately 200 W/mk, copper having a thermal conductivity of approximately 400 W/mk, beryllium-copper and/or annealed pyrolitic graphite having a thermal conductivity of approximately 1700 W/mk, among others. Additionally or alternatively, the heat exchanger 314 may comprise a heat pipe that may extend along the flow line 306 to directionally move heat away from the component 316 and/or to the fluid that flows through the flow line 306. In some examples, the heat exchanger 314 may comprise a solid piece of material and a heat pipe.

Additionally or alternatively, the heat exchanger 314 may comprise thermal strips made of, for example, annealed pyrolitic graphite having a thermal conductivity of approximately 1700 W/mk. As with the heat pipe, the thermal strips may extend along the flow line 306 to directionally move heat away from the component 316.

In operation, the component 316 generates heat, which may overheat and possibly impact the functionality of the component 316. To convey this heat away from the component 316 and, thus, decrease the likelihood of overheating the component 316, the pump 312 pumps fluid from the wellbore 302 through the inlet 308 and towards the portion 320 of the flow line 306 in a direction indicated by arrow 324. The fluid pumped through the inlet 308 may be cooler than the component 316. Therefore, as the fluid passes through the portion 320, at least some of the heat generated by the component 316 may be transferred to the fluid via convection and/or conduction and, specifically, via the interaction between the portion 320, the heat exchanger 314 and the component 316. The portion 320 may be configured to enhance heat transfer by convection in the fluid and/or conduction through the heat exchanger 314. The forced convection heat transfer coefficient for the fluid may be between about 100 $W/m^2K$ and 20,000 $W/m^2K$ depending on the flow regime, fluid properties, interface properties, among other factors. After the fluid passes through the portion 320, the pump 312 pumps the fluid to the outlet 310 in a direction indicated by arrows 326 and, thereafter, discharges the fluid into the wellbore 302. However, the pump may be provided in other locations along the flow line 306.

To substantially ensure that the fluid entering the inlet 308 is cooler than and/or not substantially affected by the temperature of the fluid exiting the outlet 310, the inlet 308 may be sufficiently spaced from the outlet 310. For example, the separation between the inlet 308 and the outlet 310 may be between about six feet and seven feet, although other separation distances are also within the scope of the present disclosure. In an example, the separation between the inlet 308 and the outlet 310 may be predetermined based on an expected or required temperature differential between the inlet 308 and the outlet 310, among other possible factors. Also, the inlet 308 may be located below the outlet 310 to minimize fluid thermal convection from the outlet 310 to the inlet 308.

Figure 3B:
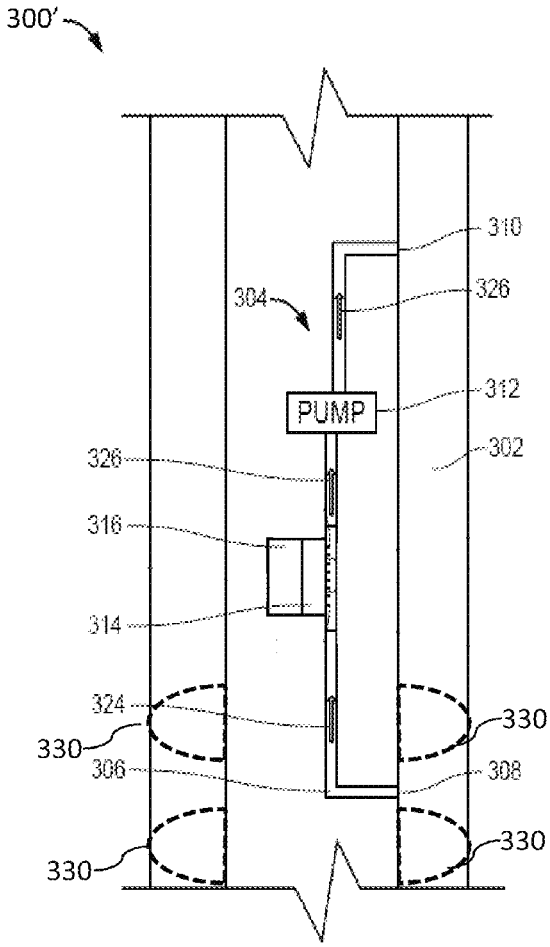

FIG. 3B depicts a portion of a downhole tool string 300' similar to the portion of the downhole tool string 300 of FIG. 3A, in which the inlet 308 is configured to pump formation fluid from an adjacent formation, for example through a portion of the wall of the wellbore 302 sealed off or isolated via a straddle packer 330.

In the example shown in FIG. 3B, the straddle packer 330 may provide a thermal and or a convection barrier. In the shown example, the packer 330, the mud cake lining the wall of the wellbore 302, and/or the formation may substantially ensure that the fluid entering the inlet 308 is cooler than and/or not substantially affected by the temperature of the fluid exiting the outlet 310. While a straddle packer 330 is depicted in FIG. 3B to establish a fluid communication with an adjacent formation, other sealing members, such as probes, may be used within the scope of the present disclosure.

Figure 3C:
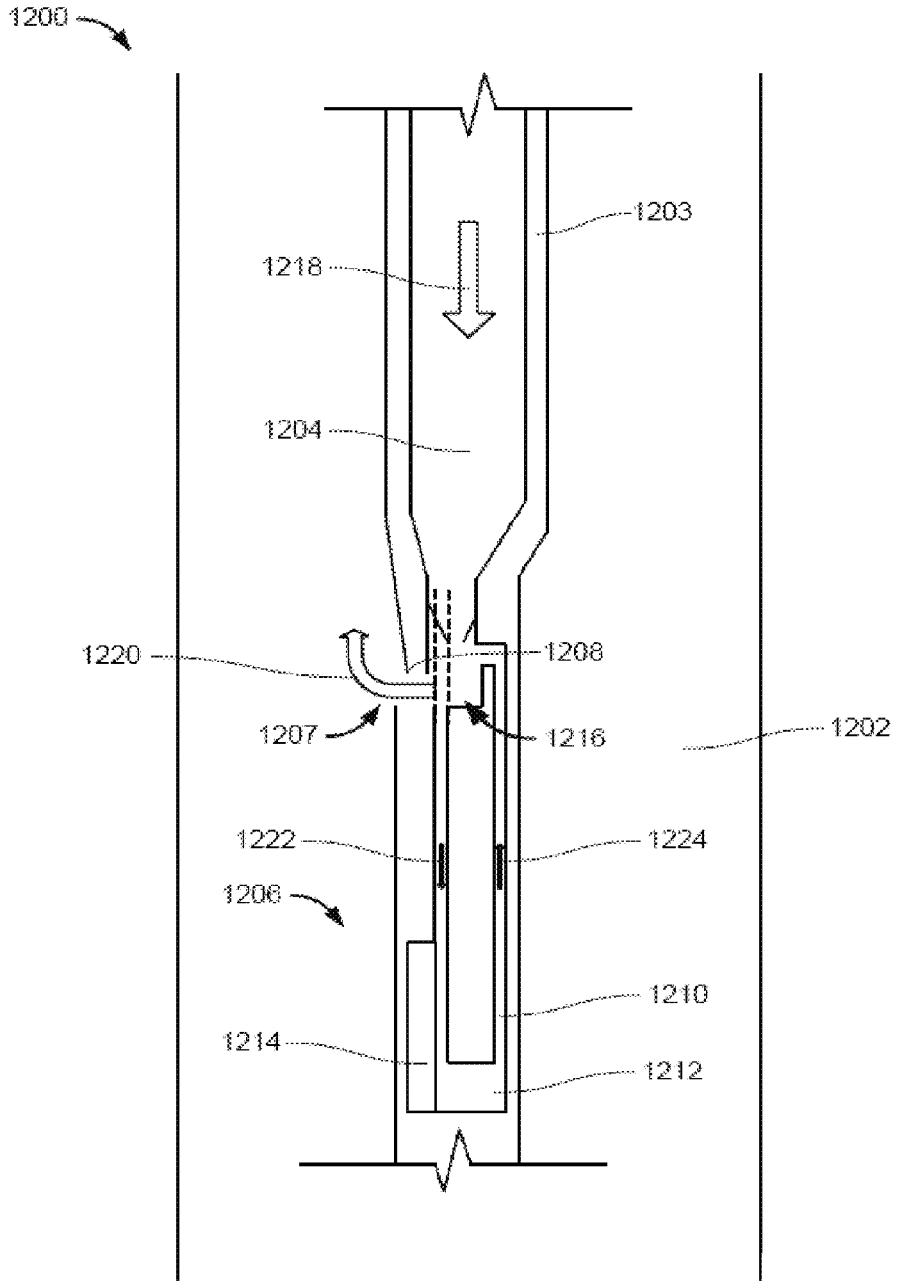

FIG. 3C depicts a portion of a downhole tool string 1200 positioned in a wellbore 1202. The downhole tool string 1200 includes drill pipe or tubing 1203, for example a distal portion of a drill string, such as the drill string 104 of FIG. 1. The drill pipe or tubing 1203 defines a first passage or flow bore 1204 configured to flow a high volume of drilling fluid through a portion of the downhole tool string 1200. Additionally, the downhole tool 1200 includes a flow diverter module 1207, for example similar to the flow diverter module 150 of FIG. 1, that diverts a portion of the drilling fluid flowing in the first passage or flow bore 1204 through an outlet 1208 into a wellbore 1202.

The downhole tool string 1200 includes a cooling apparatus 1206. The cooling apparatus 1206 includes a second passage, flow line or flow path 1210. The cooling apparatus 1206 includes a venturi pump 1216 to pump some of the drilling fluid into the second passage 1210. The venturi pump may be energized by the flow of drilling fluid in the first passage 1204. An inlet of the second passage is connected to the high pressure side of the venturi pump 1216 and an outlet of the second passage is connected to the low pressure side of the venturi pump 1216. The cooling apparatus 1206 includes a heat exchanger (e.g., a radiator) 1212 that is coupled to a component 1214.

In operation, drilling fluid is conveyed through the first passage 1204 in a direction indicated by arrow 1218. As the fluid reaches the flow diverter 1207, a portion of the drilling fluid is diverted into the wellbore 1202 in a direction indicated by arrow 1220 while another portion of the drilling fluid is pumped via the pump 1216 through the second passage 1210 in a direction indicated by arrow 1222. The fluid that flows through the second passage 1210 then flows through or adjacent to the heat exchanger 1212, thereby transferring heat generated by the component 1214 to the drilling fluid. The drilling fluid may, at least initially, have a temperature that is lower than the component 1214. After the drilling fluid passes through or adjacent to the heat exchanger 1212, the drilling fluid flows in a direction indicated by arrow 1224 and is thereafter, at least partially, discharged through the outlet 1208 into the wellbore 1202. As the inlet and the outlet of the second passage 1210 are spaced apart across the venturi pump 1216, the cross flow of drilling fluid from the outlet of the second passage 1210 to the inlet of the second passage 1210 may be minimized.

Figure 3D:
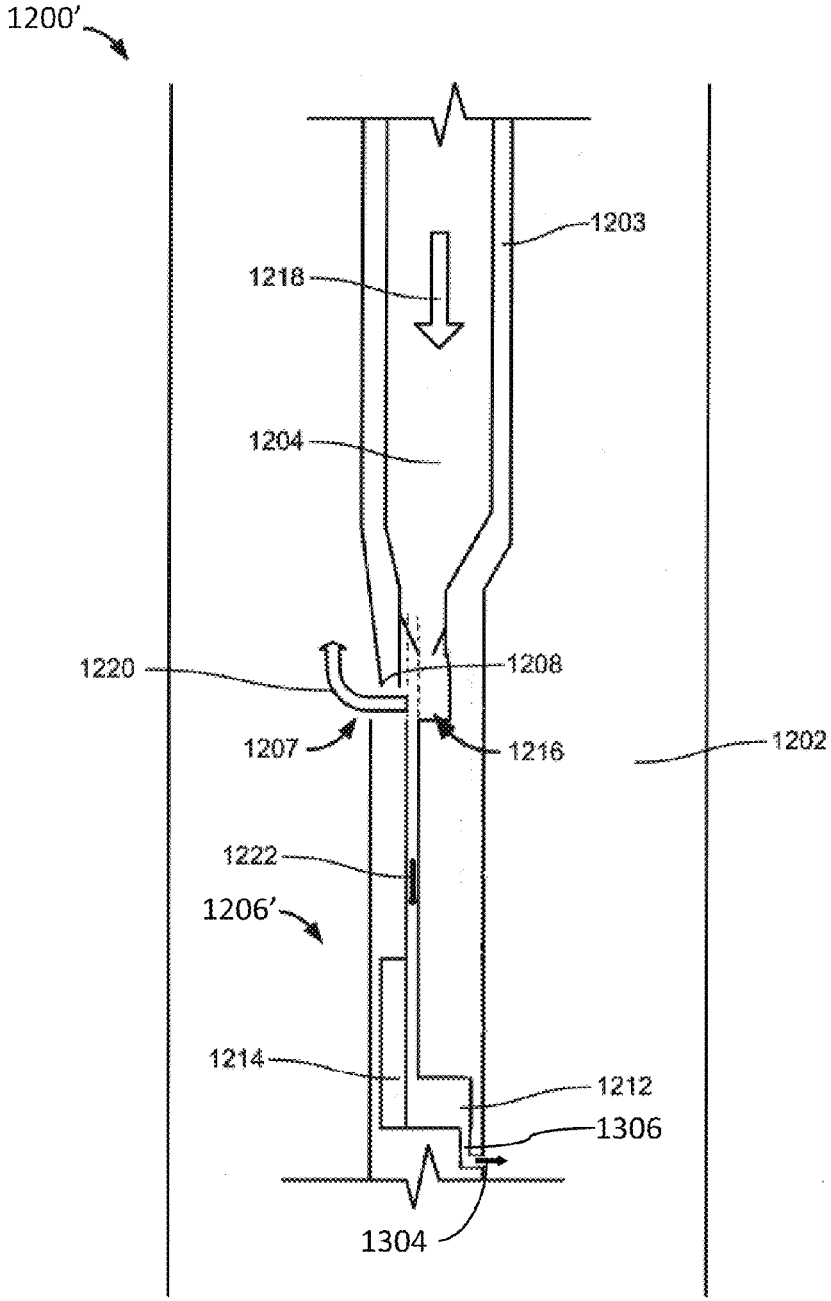

FIG. 3D depicts a portion of a downhole tool string 1200' positioned in a wellbore 1202. The downhole tool 1200' is similar to the downhole tool 1200 of FIG. 3C. However, instead of including the second passage 1210 that returns the drilling fluid through the outlet 1208, the cooling apparatus 1206' includes a second passage 1304 that may discharge drilling fluid to the wellbore 1202 at an outlet 1304 spaced apart from the outlet 1208. An inlet of the second passage 1304 may still be connected to the high pressure side of the venturi pump 1216. The cooling apparatus 1206' may be simpler to implement than the cooling apparatus 1206. However, the flow rate of drilling fluid in the passage 1304 may be relatively lower than the flow rate in the second passage 1210, for example, approximately one liter per minute.

Figure 4:
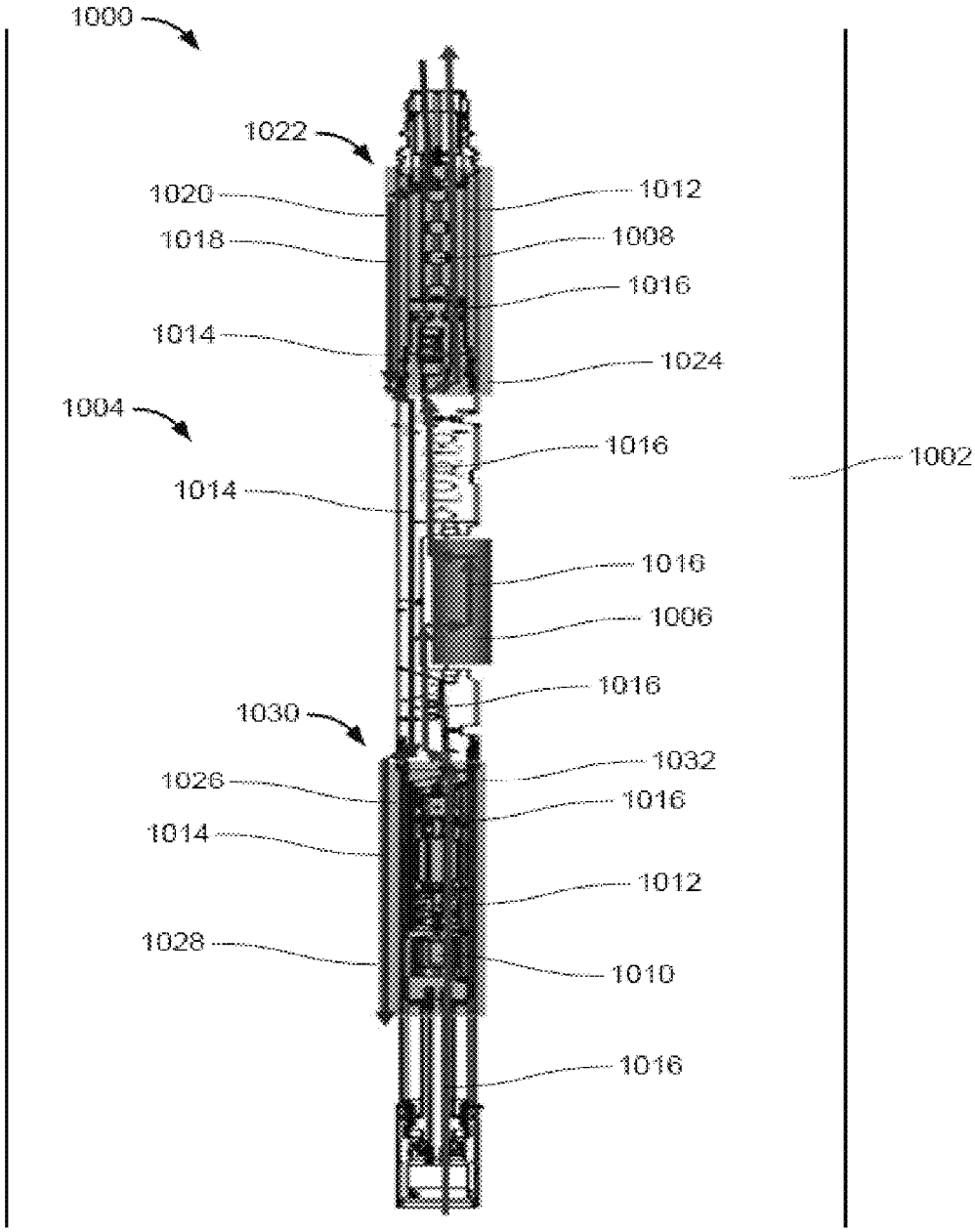
FIGS. 4 and 5 are schematic views of apparatus according to one or more aspects of the present disclosure.
Figure 5:
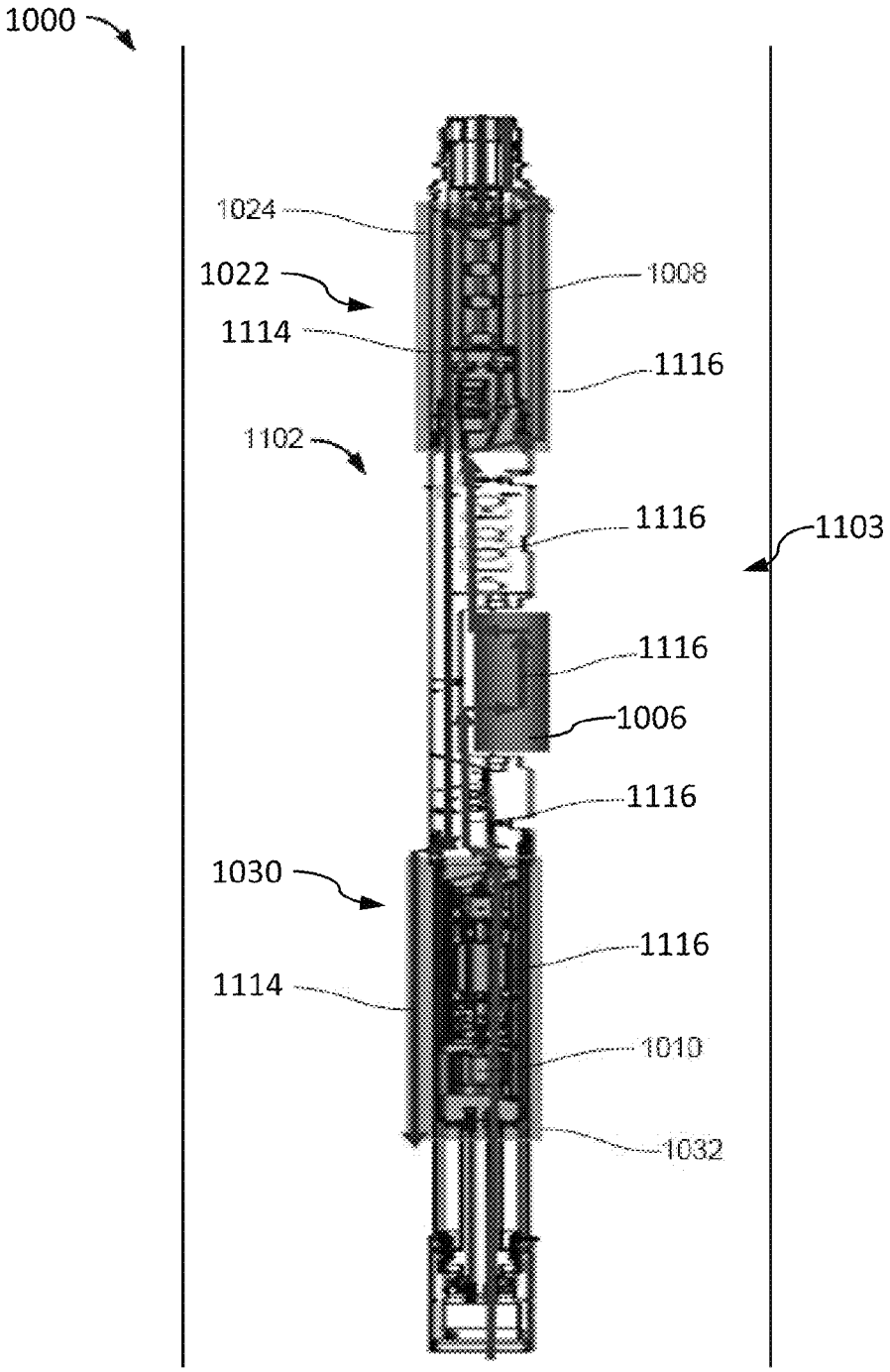

Referring collectively to FIGS. 4 and 5, a pump module 1000 (for example similar to the pump module 230 in FIG. 2) positioned in a wellbore 1002 is provided with a cooling apparatus according to one or more aspects of the present disclosure. While a cooling apparatus and is described in connection with a pump module in FIGS. 4 and 5, the cooling apparatus and methods of the present disclosure may be implemented with any other type of downhole tools or modules.

The pump module 1000 may include a displacement unit 1006, an electronics assembly (e.g., a power electronics cartridge) 1008 and a motor (e.g., an electric motor) and pump (e.g., a hydraulic pump) 1010 disposed in a tool housing 1012 of the pump module 1000.

Additionally, the pump module 1000 includes a first flow line, passage or flow path 1014, 1114 that may flow drilling fluid through at least a portion of the pump module 1000 and a second flow line or flow path 1016, 1116 that may flow formation fluid through the pump module 1000. The configuration of the flow paths 1014, 1114 and/or 1016, 1116 through the pump module 1000 may enable access to the displacement unit 1006 and/or valves (e.g., manual valves) (not shown) by a person at the surface. However, the flow paths 1014, 1114 and/or 1016, 1116 may be configured in any other arrangement.

The electronics assembly 1008 may provide power to the motor and pump 1010 and/or any other device(s) positioned in the pump module 1000. The displacement unit 1006 may include a reciprocating piston (not shown) to pump formation fluid through the second flow path 1016, 1116. The motor and pump 1010 reciprocate the piston of the displacement unit 1006, thereby pumping the formation fluid through the second flow path 1016, 1116. While not shown, the second flow path 1016, 1116 may be fluidly coupled at its lower end to other tools (e.g., formation testing tools) or modules such as, for example, packer modules, a downhole fluid analysis module and/or probe modules as shown in FIG. 2. Also, the second flow path 1016, 1116 may be fluidly coupled at its upper end to an exit port towards the wellbore 1002 for discharging unwanted formation fluid samples.

In operation, the displacement unit 1006, the electronics assembly 1008 and the motor and pump 1010, among other components, may generate heat as formation fluid is pumped through the second flow path 1016, 1116, which may impact their functionality. To transfer this heat from the electronics assembly 1008 and/or the motor and pump 1010, the tool string 1000 is provided with the cooling system.

In addition, the displacement unit 1006 may generate heat. Some of the heat may be transferred to the formation fluid via the interaction between the displacement unit 1006 and the formation fluid, thereby decreasing the temperature of the displacement unit 1006. Also, some of the heat generated by the displacement unit 1006 may be transferred to the drilling fluid in the wellbore 1002.

Turning in details to FIG. 4, a cooling system 1004 includes the flow path 1014 that flows drilling fluid through the pump module 1000. The cooling system 1014 also comprises a pump (not shown), configured to pump drilling fluid through the pump module 1000 in a generally downward direction in FIG. 4. For example, the pump may be implemented using a venturi pump as shown in FIG. 3D. After the drilling fluid passes through at least a portion of the pump module 1000, the drilling fluid may be discharged into the wellbore 1002.

The flow path 1014 may be configured to flow drilling fluid through the pump module 1000 and between opposing surfaces 1018 and 1020 of a first sleeved portion 1022 of the tool housing 1012 and a first sleeve 1024 to cool the electronics assembly 1008. The flow path 1014 also flows the drilling fluid between opposing surface 1026 and 1028 of a second sleeved portion 1030 of the tool housing 1012 and a second sleeve 1032 to cool the motor and pump 1010. The use of drilling fluid to cool both the electronics assembly 1008 and the motor and pump 1010 may be advantageous when drilling fluid circulated from the surface has a temperature of approximately less than 150 degrees Celsius (C) when the drilling fluid reaches the pump module 1000 and/or when the drilling fluid is a water-based mud (WBM). WBM typically has sufficient thermal capacitance to absorb significant amounts of heat from the components 1008 and 1010. For example, some WBM may have a thermal capacity of approximately 4000 J/kgK, while an oil-based mud may have a thermal capacity of approximately 2000 J/kgK.

The sleeves 1024 and/or 1032 may be integrally coupled to the tool housing 1012 or may be coupled to the tool housing 1012 in other manners. Alternatively, existing tools or tool strings may be retrofitted with the sleeves 1024 and/or 1032 or other examples described herein with minor modifications to provide the existing tools or tool strings with a cooling system similar to those described herein. Some modifications to existing tools or tool strings may include providing the tool with a pump of a type different from a venturi pump (such as an electric pump and/or a hydraulic pump) to pump the drilling fluid through the first flow path 1014. Some alternative or additional modifications may include providing the existing tools or tool strings with one or more of the sleeves 1024 and/or 1032.

As discussed above, the drilling fluid that flows through the pump module 1000 may be cooler than the electronics assembly 1008 and/or the motor and pump 1010. Therefore, as the drilling fluid flows through the first sleeve 1024, heat generated by the electronics assembly 1008 is transferred through, for example, a heat exchanger (not shown) coupled to the electronics assembly 1008 and the tool housing 1012 to the fluid, thereby decreasing the temperature of the electronics assembly 1008. Thereafter, as the drilling fluid flows through the second sleeve 1032, heat generated by the motor and pump 1010 is transferred through, for example, a heat exchanger coupled to the motor and pump 1010 to the fluid, thereby decreasing the temperature of the motor and pump 1010.

Turning in details to FIG. 5, a first cooling system 1102 comprises the first flow path 1114 configured to flow drilling fluid through at least a portion of the pump module 1000. The first cooling system 1102 also comprises a pump (not shown), configured to pump drilling fluid through the pump module 1000 in a generally downward direction in FIG. 4. For example, the pump may be implemented using a venturi pump as shown in FIG. 3D. After the drilling fluid passes through at least a portion of the pump module 1000, the drilling fluid may be discharged into the wellbore 1002. The first cooling system 1102 may be used to cool the motor and pump 1010.

In addition, a second cooling system 1103 comprises the second flow path 1116 configured to flow formation fluid through the pump module 1000. The second cooling system 1103 also comprises the pump 1010, configured to pump formation fluid through the pump module 1000 via the displacement unit 1006 in a generally upward direction in FIG. 5. The flow rate of the formation fluid may be approximately three liters (L) per minute (min) at approximately 2200 pounds per square inch (PSI) differential pressure or approximately six liters per minute at approximately 700 pounds per square inch. However, the flow rate to which the formation fluid is exposed may vary depending on the performance of the pump 1010, the characteristics of the displacement unit displacement unit 1006 and/or the formation properties. After the formation fluid passes through at least a portion of the pump module 1000, the formation fluid may be discharged into the wellbore 1002. The second cooling system 1103 may be used to cool the electronics assembly 1008.

Using the drilling fluid and the formation fluid in this manner to the cool the motor and pump 1010 and the electronics assembly 1008, respectively, may be advantageous when the temperature of the drilling fluid would otherwise be too high to adequately cool both the electronics assembly 1008 and the motor and pump 1010.

While FIG. 5 depicts a configuration in which the fluid that flows through the first flow path 1114 is used to cool the motor and pump 1010 and the fluid that flows through the second flow path 1116 is used to cool the electronics assembly 1008, other alternative configurations may be used instead depending on the formation fluid temperature, the mud system used, and/or other factors. For example, the fluid that flows through the first flow path 1114 may be used to cool the electronics assembly 1008 and the fluid that flows through the second flow path 1116 may be used to cool the motor and pump 1010.

FIGS. 6-11 depicts different views of a portion of a cooling system according to one or more aspects of the present disclosure. For example, the portion of the cooling system shown in FIGS. 6-11 may be used to implement the first sleeved portions 1022 and/or the second sleeved portion 1030 in FIGS. 4 and 5.

Figure 6:
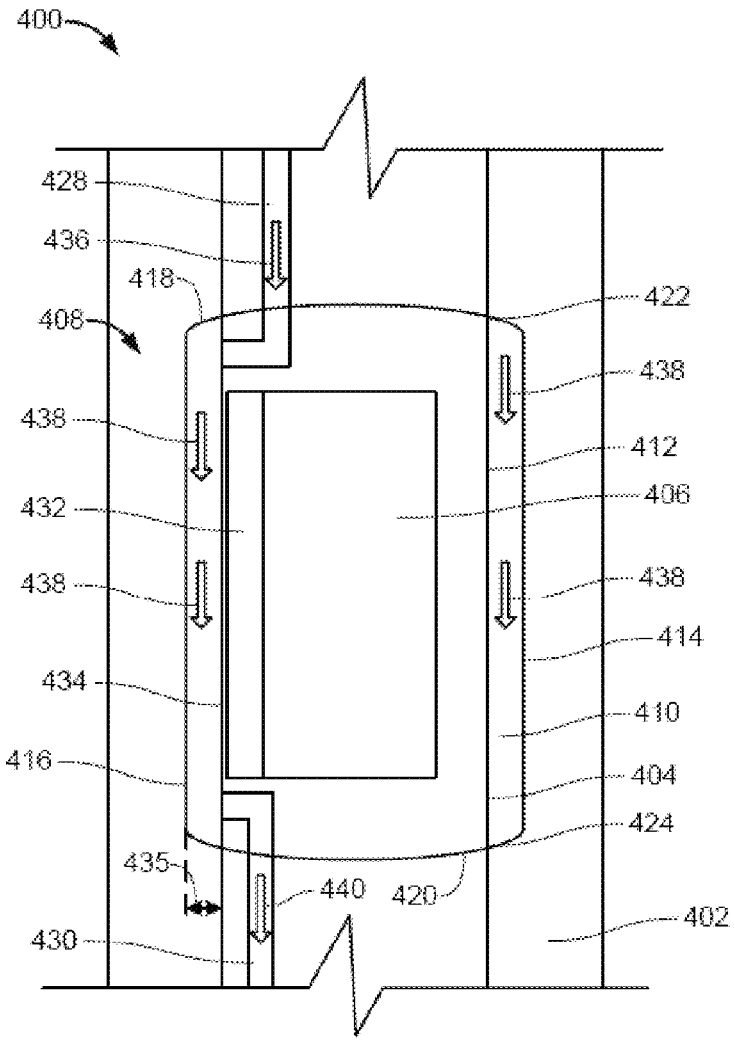
FIG. 6 is a schematic view of apparatus according to one or more aspects of the present disclosure.
Figure 7:
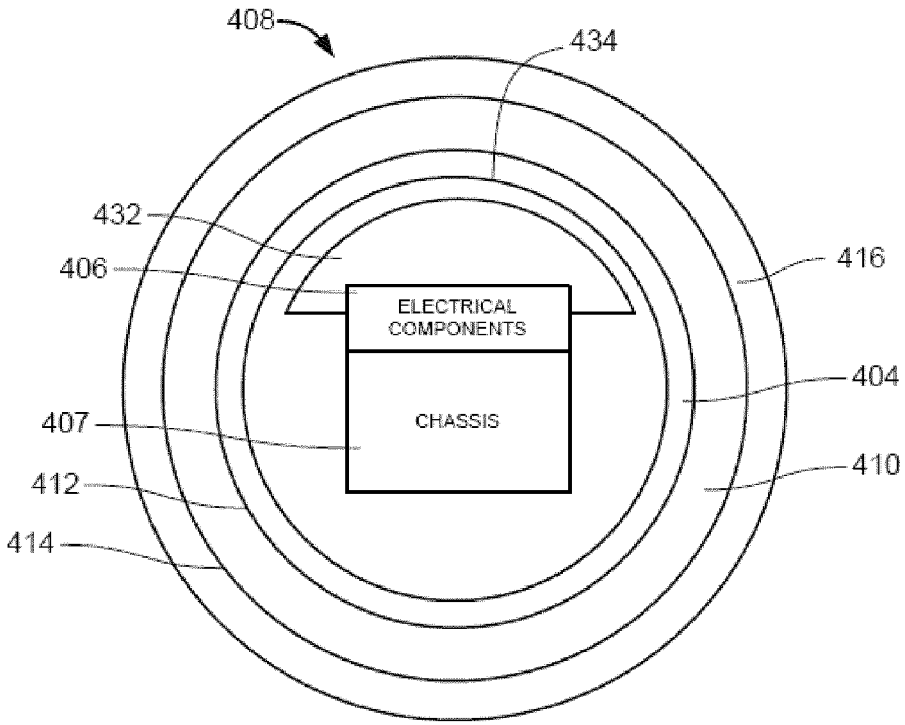
FIGS. 7-11 are schematic views of apparatus according to one or more aspects of the present disclosure.

Turning in detail to FIGS. 6 and 7, the downhole tool 400 includes a tool housing or tool pressure housing 404 positioned in a wellbore 402, in which a component or heat-generating component 406 is disposed, and a cooling apparatus 408. The component 406 may be an electrical component that is disposed in a chassis or electronics chassis 407 of the downhole tool 400. However, the component 406 may be any other component or apparatus positioned in the downhole tool 400 such as, for example, a downhole motor, a downhole pump, power electronics, an electronic assembly, a fluid measurement unit, and/or a sensor, among others.

The cooling apparatus 408 includes a flow path, passage, gap or chamber 410 between an exterior surface 412 of the tool housing 404 and an interior surface 414 of a sleeve or cooling sleeve 416 through which the tool housing 404 extends. The sleeve 416 includes opposing ends 418 and 420 that define respective apertures 422 and 424 that are sized to engage or sealingly engage the exterior surface 412 of the tool housing 404 to substantially prevent fluid from entering the flow path 410 directly from the wellbore 402. Alternatively, the sleeve 416 may be integrally coupled to the tool housing 404. Additionally, the cooling apparatus 408 fluidly communicates with an inlet flow line 428 to permit the flow of cooling fluid (e.g., formation fluid and/or drilling fluid) into the flow path 410 and an outlet flow line 430 to permit the flow of fluid out of the flow path 410. To further enable heat generated by the component 406 to be transferred to the fluid in the flow path 410, the cooling apparatus 408 may include a heat exchanger or heat sink 432 coupled between the component 406 and an interior surface 434 of the tool housing 404 adjacent the flow path 410. The heat exchanger 432 may be biased toward the interior surface 434 via a spring element (not shown) to bring the heat exchanger 432 into firm contact with the interior surface 434 to increase the thermal coupling of (i.e., reduce the thermal resistance between) the heat exchanger 432 and the tool housing 404.

To increase the rate and/or amount of heat dissipated or conducted from the component 406 through the heat exchanger 432 to the cooling fluid as the cooling fluid flows through the flow path 410, the flow path 410 may be configured to enhance the dissipation of heat from the tool housing 404. Specifically, the fluid flow may be diverted, controlled or guided within the flow path 410 to enable a majority of the fluid to flow past the heat exchanger 432 and/or a fluid regime in the flow path 410 may be caused to be turbulent. For example, as discussed below, to restrict and/or limit fluid flow through a portion of the flow path 410 opposite the surface 434 and encourage or increase fluid flow through another portion of the flow path 410 adjacent the surface 434, an object may be positioned in the flow path 410 and/or the sleeve 416 may be axially offset relative to a longitudinal axis of the tool housing 404. Additionally, or alternatively, the fluid regime in the flow path 410 may be caused to be turbulent by, for example, disposing one or more obstacles in the flow path 410 and/or decreasing a distance 435 between the surfaces 412 and 414.

In operation, the component 406 generates heat, which may impact the functionality of the component 406. To convey this heat away from the component 406, a pump (e.g., similar or identical to the pump 312 of FIGS. 3A-3B and/or the pump 1216 of FIGS. 3C-3D) pumps cooling fluid (e.g., formation fluid and/or drilling fluid) through the inlet flow line 428 and into the flow path 410 in a direction indicated by arrow 436. As the fluid enters the flow path 410, the fluid is typically cooler than the component 406 and, thus, as the fluid flows past the component 406 in a direction indicated by arrows 438, the interaction between the component 406, the heat exchanger 432, the tool housing 404 and the fluid causes heat from the component 406 to be transferred from the component 406 through the heat exchanger 432 to the fluid. In this example, the configuration of the sleeve 416 surrounding the tool housing 404 enables the fluid to substantially surround the tool housing 404, thereby maximizing the amount of the surface 412 exposed to the fluid and increasing the heat transfer between the fluid and the component 406. After the fluid passes through the flow path 410, the pump conveys the fluid to the outlet flow line 430 in a direction indicated by arrow 440 and, thereafter, discharges the fluid into, for example, the wellbore 402.

While the flow direction of cooling fluid is depicted in FIG. 6 in a general downward direction, the flow of cooling fluid may alternatively be in an upward direction.

Figure 8:
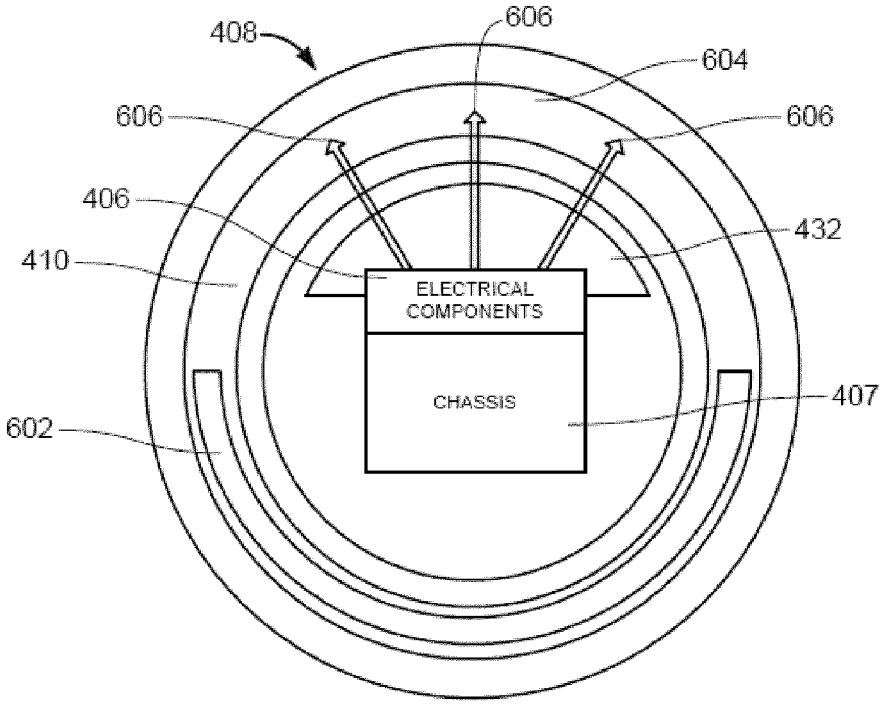
Figure 9:
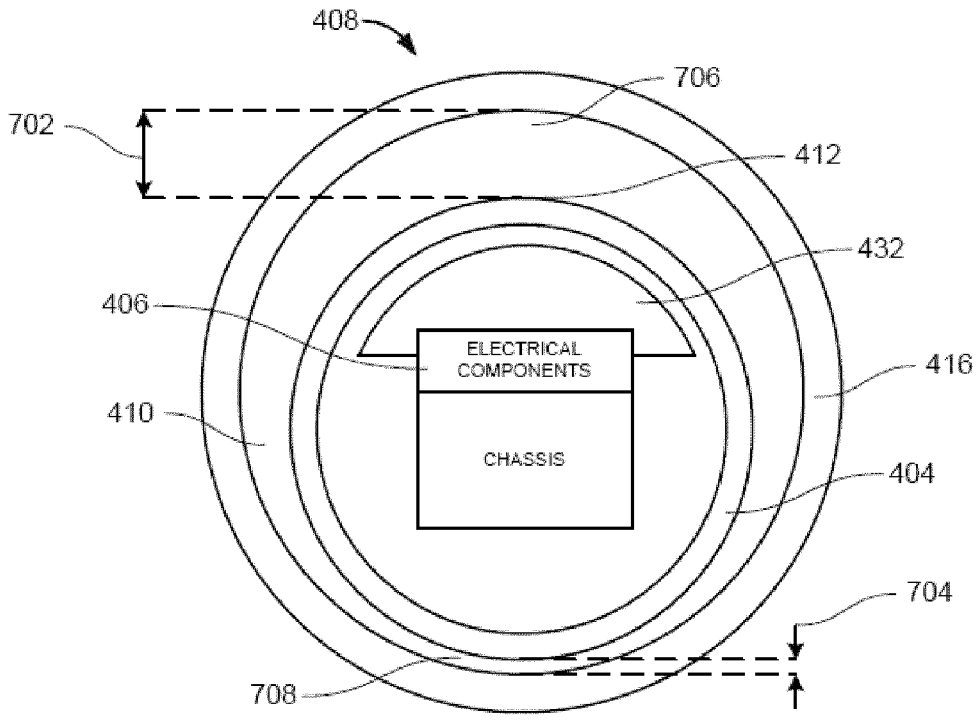

FIGS. 8 and 9 illustrate examples in which the fluid flow is diverted to enable a majority of the fluid to flow past the heat exchanger 432. Increasing the amount of the fluid flowing past the heat exchanger 432 may increase the amount and/or rate of heat transfer from the component 406 to the fluid.

FIG. 8 depicts an example embodiment of the cooling apparatus 408 of FIGS. 6 and 7 in which an object or block 602 is positioned in the flow path 410 to divert a majority of the fluid to flow through a portion 604 of the flow path 410 and past the heat exchanger 432. As indicated by arrows 606, as the fluid flows through the flow path 410, heat generated by the component 406 is transferred through the heat exchanger 432 to the fluid, thereby cooling (i.e., decreasing the temperature of) the component 406.

FIG. 9 depicts an example embodiment of the cooling apparatus 408 of FIGS. 6 and 7 in which the sleeve 416 is axially offset relative to the tool housing 404. Specifically, the longitudinal axis of the sleeve 416 is offset from (i.e., is not coincident with) the longitudinal axis of the tool housing 404. Offsetting the position of the sleeve 416 relative to the tool housing 404 increases a distance 702 between the sleeve 416 and the tool housing 404 and decreases a distance 704 between the sleeve 416 and the tool housing 404. Offsetting the sleeve 416 relative to the tool housing 404 in this manner enables a majority of the fluid to flow through a portion 706 of the flow path 410 past the heat exchanger 432 while limiting the fluid flow through another portion 708 of the flow path 410 opposite the portion 706.

Figure 10:
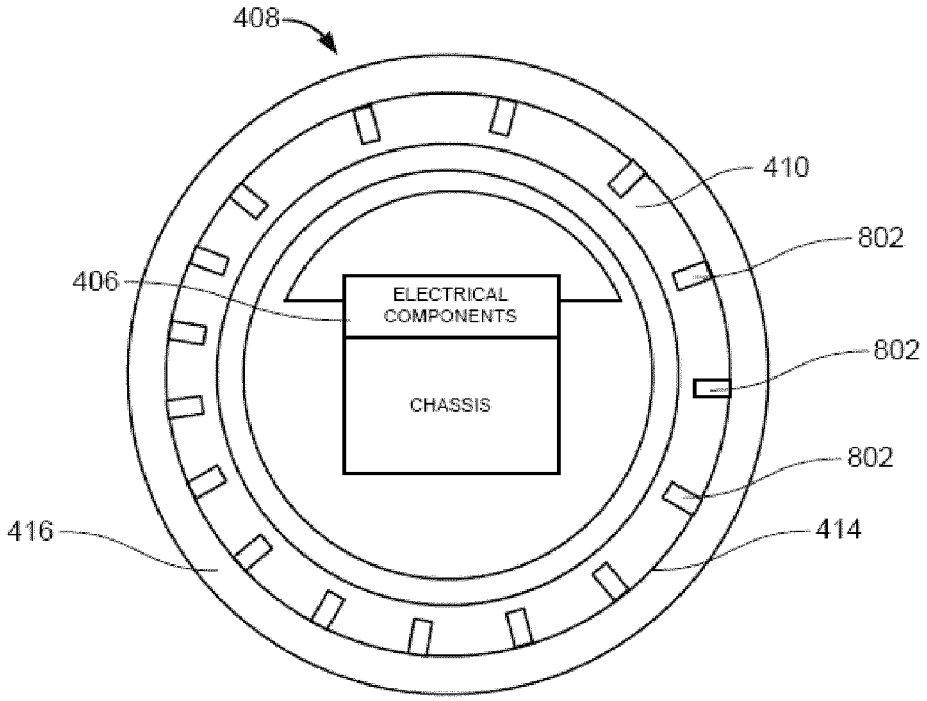
Figure 11:
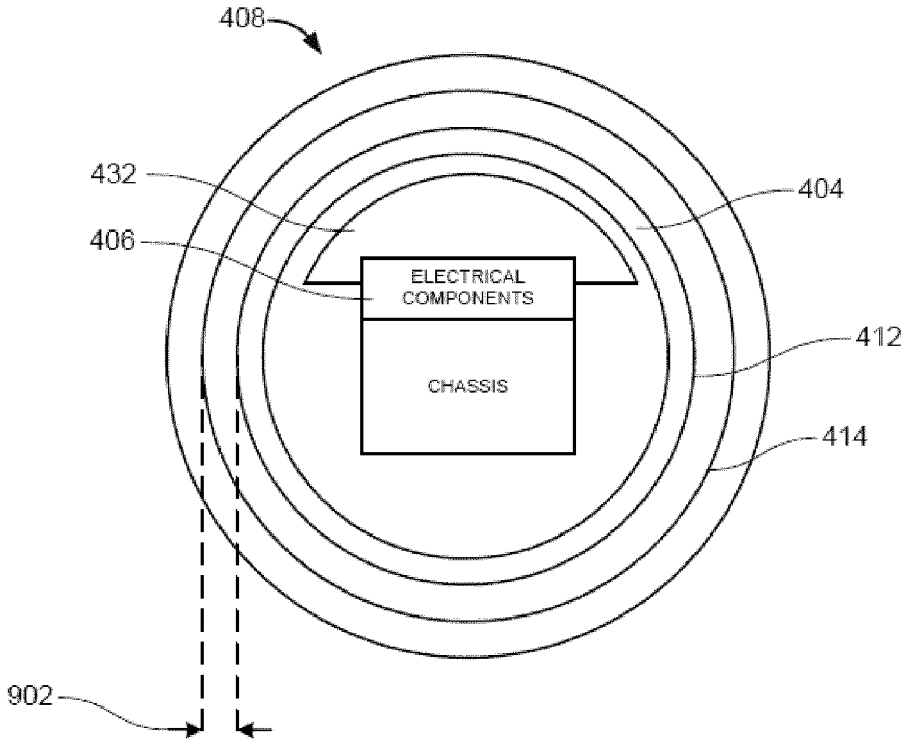

FIGS. 10 and 11 illustrate examples in which a fluid regime in the flow path 410 is caused to be turbulent. The amount and/or rate of heat transfer from the component 406 to the fluid may increase when the fluid flow is turbulent as compared to when the fluid flow is laminar.

FIG. 10 depicts an example embodiment of the cooling apparatus 408 of FIGS. 6 and 7 in which obstacles 802 disposed in the flow path 410 extend from the surface 414 of the sleeve 416. While the obstacles 802 are depicted as having a substantially rectangular shape and extending inwardly from the surface 414 of the sleeve 416, the obstacles 802 may be any other shape and may be disposed in any other position in the flow path 410. As the fluid flows through the flow path 410, the flow of the fluid is disrupted by the obstacles 802, thereby causing the fluid flow to be turbulent.

FIG. 11 depicts an example embodiment of the cooling apparatus 408 of FIGS. 6 and 7 in which a distance 902 between the surfaces 412 and 414 of the tool housing 404 and the sleeve 416, respectively, is sized to cause the fluid flow in the flow path 410 to be turbulent. As the distance 902 between the surfaces 412 and 414 decreases, the likelihood that the fluid flow in the flow path 410 will be turbulent may increase.

Figure 12:
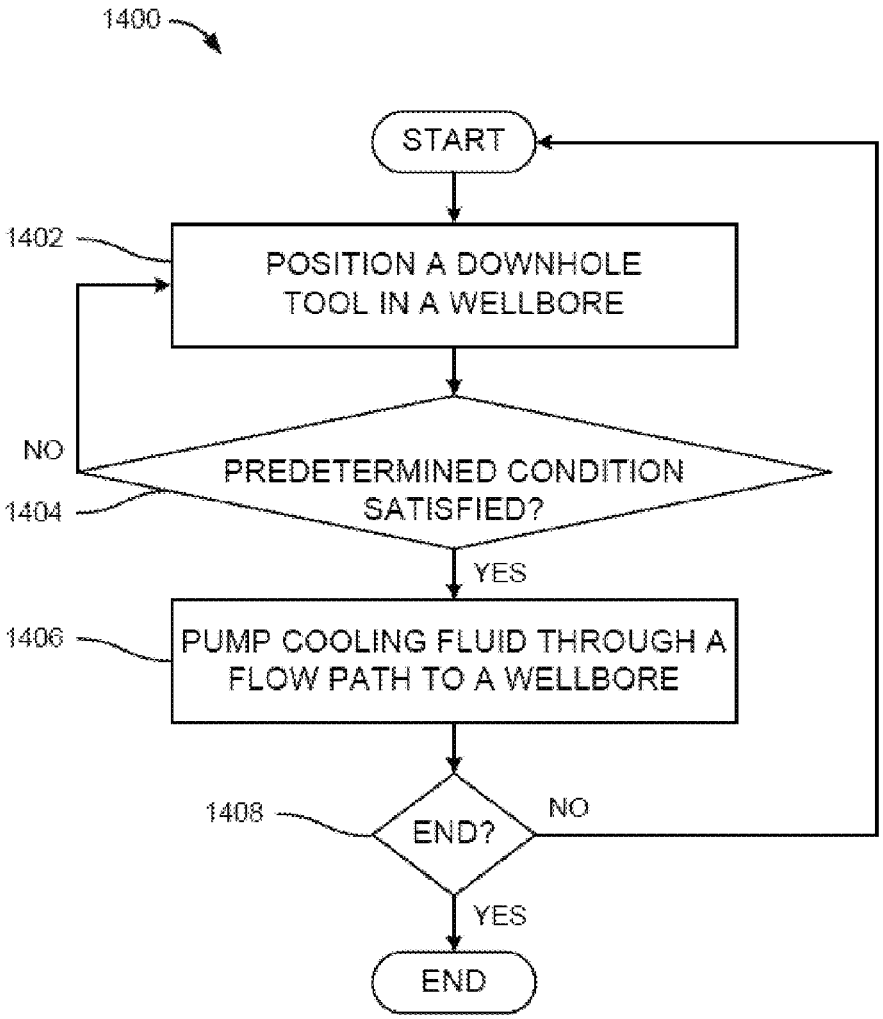
FIG. 12 is a flow diagram of at least a portion of a method according to one or more aspects of the present disclosure.

FIG. 12 is a flow diagram depicting a method 1400 that may be performed in accordance with one or more aspects of the present disclosure. The example method 1400 of FIG. 12 may be implemented using software and/or hardware. In some example implementations, the flow diagram can be representative of example machine readable instructions and, thus, the example method 1400 of the flow diagram may be implemented entirely or in part by executing the machine readable instructions. Such machine readable instructions may be executed by one or more aspects of the present disclosure. In particular, a processor or any other device to execute machine readable instructions may retrieve such instructions from a memory device (e.g., a random access memory (RAM), a read only memory (ROM), etc.) and execute those instructions.

In some example implementations, one or more of the operations depicted in the flow diagram of FIG. 12 may be implemented manually. Although the example method 1400 is described with reference to the flow diagram of FIG. 12, persons of ordinary skill in the art will readily appreciate that other methods to implement one or more aspects of the present disclosure may additionally or alternatively be used. For example, the order of execution of the blocks depicted in the flow diagram of FIG. 12 may be changed and/or some of the blocks described may be rearranged, eliminated, or combined.

Turning to FIG. 12, the example method 1400 begins by positioning a downhole tool in a wellbore (block 1402). The downhole tool may be the example tool string 106 of FIG. 1, 200 of FIG. 2, 300 of FIG. 3A, 300' of FIG. 3B, 1200 of FIG. 3C, 1200' of FIG. 3D, among others. The example method 1400 then determines whether or not a predetermined condition has been satisfied (block 1404). For example, the predetermined condition may be a predetermined amount of time has elapsed, a sampling operation has begun and/or a drilling operation has been temporarily suspended. If the predetermined condition has not been satisfied, control returns to block 1402. However, if the example method 1400 determines that the predetermined condition has been satisfied, control moves to block 1406. Cooling fluid (e.g., drilling fluid and/or formation fluid) is then pumped through a flow path to a wellbore (block 1406). In some examples, the flow path may comprise an inlet and an outlet that are both in fluid communication with the wellbore. As the cooling fluid flows through the flow path, heat from a component in the downhole tool may be dissipated (e.g., conducted) through a heat exchanger to the cooling fluid in the flow path. In some examples, the flow regime in the flow path may be caused to be turbulent by, for example, positioning one or more objects in the flow path and/or decreasing a size of the flow path. The example method 1400 then determines whether the method 1400 should return to block 1402 (block 1408), otherwise the example method 1400 ends.

Figure 13:
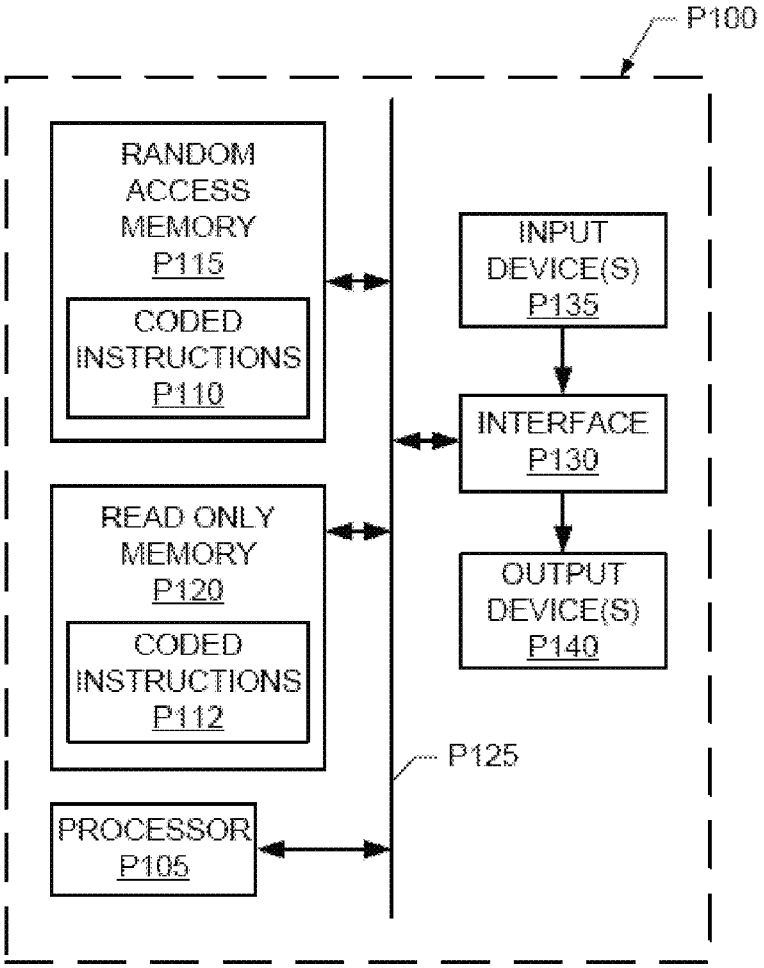
FIG. 13 is a schematic illustration of apparatus according to one or more aspects of the present disclosure.

FIG. 13 is a schematic diagram of an example processor platform P100 that may be used and/or programmed to implement the logging and control computer 144 of FIG. 1 and/or downhole control system 214 of FIG. 2. For example, the processor platform P100 can be implemented by one or more general purpose processors, processor cores, microcontrollers, etc.

The processor platform P100 of the example of FIG. 13 includes at least one general purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example methods and apparatus described herein.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown).

The processor platform P100 also includes an interface circuit P130. The interface circuit P130 may be implemented by any type of interface standard, such as an external memory interface, serial port, general purpose input/output, etc. One or more input devices P135 and one or more output devices P140 are connected to the interface circuit P130.

In view of the foregoing description and the figures, it should be clear that the present disclosure introduces an apparatus including a cooling apparatus for use with a downhole tool. The cooling apparatus may include a flow passage having an inlet and an outlet, where the outlet is configured for fluid communication with a wellbore, and where the inlet is spaced from the outlet. The cooling apparatus may also include a pump configured to convey at least one of a drilling fluid or a formation fluid between the inlet and the outlet. The inlet may be configured for fluid communication with the wellbore. Additionally, the apparatus may include a heat exchanger coupled to a surface adjacent the flow passage and a component of the downhole tool to convey heat from the component to the cooling fluid.

The flow passage of the cooling apparatus may include a portion of a flow line of the downhole tool, and the flow passage may include a substantially flat surface adjacent the surface, which may be thermally conductive and which may be comprised of at least one of copper, a barium copper alloy or beryllium-copper.

Further, one or more extensions may extend into the flow passage adjacent the surface, and the flow passage may include a gap between a housing of the downhole tool and a sleeve that at least partially surrounds the housing, within which the component may be disposed. The component may include at least one of an electric motor, a second pump or an electronics assembly. A block or an obstacle may be positioned in a portion of the gap to increase an amount of the at least one of the drilling fluid or the formation fluid flowing past the heat exchanger. Also, the sleeve may be axially offset relative to a longitudinal axis of the housing.

The flow passage of the cooling apparatus may be configured to cause turbulence in fluid flowing through the passage, and the pump may include a venturi pump. Further, the cooling apparatus may include a second flow passage configured to flow a second cooling fluid past a second heat exchanger, where the second heat exchanger is adjacent the second flow passage and a second component of the downhole tool.

The present disclosure also introduces a method of cooling a component in a downhole tool where the method may involve positioning the downhole tool in a wellbore, determining if a predetermined condition has been satisfied and, in response to the predetermined condition being satisfied, pumping at least one of a drilling fluid or a formation fluid through a flow path of the downhole tool to the wellbore to cause heat from a component in the downhole tool to be conducted through a heat exchanger to the at least one of the drilling fluid or the formation fluid in the flow path.

The method may also involve causing a flow of the at least one of the drilling fluid or the formation fluid in the flow path to be turbulent. Still further, the method may involve pumping the at least one of the drilling fluid or the formation fluid between an inlet and an outlet that are in fluid communication with the wellbore.

The present disclosure also introduces an apparatus comprising: a cooling apparatus for use with a downhole tool, comprising: a first flow passage having an inlet and an outlet, wherein the first flow passage comprises a portion of a flow line of the downhole tool, wherein the outlet is configured for fluid communication with a wellbore, and wherein the inlet is spaced from the outlet and is configured for fluid communication with the wellbore; a first pump configured to convey a first cooling fluid between the inlet and the outlet, wherein the cooling fluid comprises at least one of a drilling fluid or a formation fluid; a first heat exchanger coupled to a surface adjacent the flow passage and a component of the downhole tool, wherein the component is disposed in a housing of the downhole tool, and wherein the first heat exchanger is configured to convey heat from the component to the first cooling fluid; and a second flow passage configured to flow a second cooling fluid past a second heat exchanger, wherein the second heat exchanger is adjacent the second flow passage and a second component of the downhole tool.

The foregoing outlines features of several embodiments so that those skilled in the art may better understand the aspects of the present disclosure. Those skilled in the art should appreciate that they may readily use the present disclosure as a basis for designing or modifying other processes and apparatus for carrying out the same purposes and/or achieving the same advantages of the embodiments introduced herein. Those skilled in the art should also realize that such equivalent constructions do not depart from the spirit and scope of the present disclosure, and that they make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A downhole tool, comprising:

a housing;

a heat producing component disposed in the housing;

a sleeve disposed around the housing to define a flow passage between the sleeve and the housing, the flow passage having an inlet and an outlet, wherein the outlet is configured for fluid communication with a wellbore, and wherein the inlet is spaced from the outlet;

a pump configured to convey at least one of a drilling fluid or a formation fluid between the inlet and the outlet; and a heat exchanger coupled to a surface adjacent the flow passage and the heat producing component, wherein the heat exchanger is configured to convey heat from the heat producing component to the at least one of the drilling fluid or the formation fluid.

2. The apparatus of claim 1 wherein the surface comprises at least one of copper, a beryllium copper and a barium copper alloy.

3. The apparatus of claim 1 further comprising one or more extensions that extend into the flow passage adjacent the surface.

4. The apparatus of claim 1 further comprising a block positioned in a portion of the flow passage and configured to increase an amount of the at least one of the drilling fluid or the formation fluid flowing past the heat exchanger.

5. The apparatus of claim 1 wherein the sleeve is axially offset relative to a longitudinal axis of the housing to provide increased flow adjacent the heat exchanger.

6. The apparatus of claim 1 further comprising at least one obstacle disposed in the flow passage.

7. The apparatus of claim 1 wherein the flow passage is configured to cause turbulence in fluid flowing through the flow passage.

8. The apparatus of claim 1 wherein the pump comprises a venturi pump energized by flow of the drilling fluid.

9. The apparatus of claim 1 wherein the inlet is configured for fluid communication with the wellbore.

10. The apparatus of claim 1 wherein the heat producing component comprises at least one of an electric motor, a second pump or an electronics assembly.

11. The apparatus of claim 1 wherein the at least one of the drilling fluid or the formation fluid forms at least a portion of a first cooling fluid, and wherein the apparatus further comprises a second flow passage configured to flow a second cooling fluid past a second heat exchanger, wherein the second heat exchanger is adjacent the second flow passage and a second component of the downhole tool.

12. The downhole tool of claim 1, wherein the inlet is in fluid communication with a drilling fluid passage of the downhole tool.

13. A method of cooling a component in a downhole tool, comprising:

positioning the downhole tool in a wellbore;

determining that a predetermined condition has been satisfied; and in response to the predetermined condition being satisfied, pumping at least one of a drilling fluid or a formation fluid through a flow path, formed between a housing of the downhole tool and a sleeve disposed around the housing, to the wellbore to cause heat from a component in the downhole tool to be conducted through a heat exchanger to the at least one of the drilling fluid or the formation fluid in the flow path.

14. The method of cooling of claim 13 further comprising causing a flow of the at least one of the drilling fluid or the formation fluid in the flow path to be turbulent.

15. The method of cooling of claim 13 further comprising pumping the at least one of the drilling fluid or the formation fluid between an inlet and an outlet that are in fluid communication with the wellbore.

16. The downhole tool of claim 13, comprising a second sleeve disposed around a second portion of the housing, wherein the drilling fluid passage extends through the second portion of the housing.

17. The downhole tool of claim 16, comprising a displacement unit disposed in the housing between the first portion of the housing and the second portion of the housing.

18. The downhole tool of claim 13, comprising a formation fluid passage extending through the first portion of the housing.

19. The downhole tool of claim 13, wherein the pump comprises a venturi pump energized by flow of the drilling fluid in the drilling fluid passage.

20. The method of claim 13, wherein the predetermined condition comprises initiation of a sampling operation.

21. A downhole tool, comprising:

an external housing having a drilling fluid passage to convey a drilling fluid through the downhole tool;

a heat producing component disposed in a first portion of the housing;

a first sleeve disposed around the first portion of the housing to define a flow passage between the sleeve and the housing, the flow passage having an inlet and an outlet, wherein the outlet is configured for fluid communication with a wellbore, and wherein the inlet is spaced from the outlet and configured for fluid communication with the drilling fluid passage;

a pump configured to convey the drilling fluid between the inlet and the outlet; and a heat exchanger coupled to a surface adjacent the flow passage and the heat producing component, wherein the heat exchanger is configured to convey heat from the heat producing component to the drilling fluid.

* * * * *